US010201987B2

(12) United States Patent
Onuma et al.

(10) Patent No.: US 10,201,987 B2
(45) Date of Patent: Feb. 12, 2019

(54) PRINTING APPARATUS AND PLATEN

(71) Applicant: CANON KABUSHIKI KAISHA, Tokyo (JP)

(72) Inventors: Takahide Onuma, Kawasaki (JP); Tetsuji Kurata, Yokohama (JP); Seiji Ogasawara, Machida (JP); Masakazu Tsukuda, Yokohama (JP); Yasunori Saito, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/716,889

(22) Filed: Sep. 27, 2017

(65) Prior Publication Data

US 2018/0015741 A1 Jan. 18, 2018

Related U.S. Application Data

(62) Division of application No. 15/160,382, filed on May 20, 2016, now Pat. No. 9,802,426.

(30) Foreign Application Priority Data

May 27, 2015 (JP) ..... 2015-108000

(51) Int. Cl.
*B41J 11/00* (2006.01)
*B41J 11/06* (2006.01)

(52) U.S. Cl.
CPC ..... *B41J 11/0085* (2013.01); *B41J 11/0065* (2013.01); *B41J 11/06* (2013.01)

(58) Field of Classification Search
CPC ..... B41J 2002/1742; B41J 2002/1728; B41J 2/1721; B41J 2/16523; B41J 11/0085; B41J 11/0065; B41J 11/06
See application file for complete search history.

(56) References Cited

U.S. PATENT DOCUMENTS 5,140,344 A 8/1992 Tsukada et al.
5,398,049 A 3/1995 Terasawa et al.
(Continued)

FOREIGN PATENT DOCUMENTS

CN 1827382 A 9/2006
CN 101559670 A 10/2009
(Continued)

OTHER PUBLICATIONS

Machine Translation of Oct. 5, 2018 IDS—NPL #1—AIPN Dossier retrieved by STIC Translations. Oct. 15, 2018.*
(Continued)

*Primary Examiner* — John P Zimmermann
(74) *Attorney, Agent, or Firm* — Venable LLP

(57) ABSTRACT

A platen includes a plurality of supporting portions capable of supporting a sheet; negative pressure chambers, to which a negative pressure is supplied, so as to suck a sheet facing the supporting portions to the supporting portions; and an ink receiver that receives ink ejected from a printhead to the outside of the sheet supported by the supporting portions. The plurality of supporting portions are arranged in a sheet width direction transverse a sheet conveyance direction. The plurality of negative pressure chambers are disposed in a manner corresponding to the plurality of supporting portions, respectively.

7 Claims, 15 Drawing Sheets

(56) References Cited

U.S. PATENT DOCUMENTS

| | | | | |
|---|---|---|---|---|
| 5,880,754 | A | 3/1999 | Niikura et al. | |
| 6,471,315 | B1 | 10/2002 | Kurata | |
| 6,886,909 | B2 | 5/2005 | Ogasawara | |
| 6,899,411 | B2 | 5/2005 | Niikura et al. | |
| 7,284,814 | B2 | 10/2007 | Ogasawara | |
| 8,419,155 | B2 | 4/2013 | Kawakami et al. | |
| 8,613,514 | B2 | 12/2013 | Ozaki | |
| 8,646,902 | B2 | 2/2014 | Toyoshima | |
| 8,950,844 | B2 | 2/2015 | Takahashi et al. | |
| 9,090,099 | B2 | 7/2015 | Ogasawara | |
| 2002/0041303 | A1 | 4/2002 | Yoshinaga | |
| 2005/0062794 | A1 | 3/2005 | Kanamitsu et al. | |
| 2005/0093919 | A1 | 5/2005 | Takatsuka et al. | |
| 2006/0181576 | A1 | 8/2006 | Endo et al. | |
| 2010/0118098 | A1* | 5/2010 | Ebihara | B41J 2/155 347/104 |
| 2010/0171788 | A1 | 7/2010 | Heo et al. | |
| 2011/0074872 | A1* | 3/2011 | Ozaki | B41J 2/16523 347/30 |
| 2011/0193909 | A1* | 8/2011 | Takamoto | B41J 11/0085 347/16 |
| 2013/0050375 | A1 | 2/2013 | Ishimori et al. | |
| 2014/0022300 | A1 | 1/2014 | Lo et al. | |
| 2016/0243834 | A1 | 8/2016 | Nakagawa et al. | |

FOREIGN PATENT DOCUMENTS

| | | | |
|---|---|---|---|
| CN | 102189785 | A | 9/2011 |
| CN | 102950914 | A | 3/2013 |
| JP | 2006-021475 | A | 1/2006 |
| JP | 2006-281762 | A | 10/2006 |
| JP | 2010-018367 | A | 1/2010 |
| JP | 2014-124830 | A | 7/2014 |

OTHER PUBLICATIONS

U.S. Appl. No. 15/160,532, filed May 20, 2016. Applicant: Tetsuji Kurata.

U.S. Appl. No. 15/160,574, filed May 20, 2016. Applicant: Seiji Ogasawara.

U.S. Appl. No. 15/160,756, filed May 20, 2016. Applicants: Seiji Ogasawara, et al.

Office Action dated May 3, 2018, in Chinese Patent Application No. 201610363073.6.

Office Action dated Sep. 25, 2018, in Japanese Patent Application No. 2015-108000.

* cited by examiner

PRINTING APPARATUS AND PLATEN

This application is a divisional of U.S. patent application Ser. No. 15/160,382, which was filed May 20, 2016 (allowed), the contents of which are incorporated herein by reference.

BACKGROUND OF THE INVENTION

Field of the Invention

The present invention relates to an inkjet printing apparatus provided with a platen for supporting a sheet.

Description of the Related Art

Japanese Patent Laid-Open No. 2006-021475 discloses an inkjet printing apparatus capable of forming an image without a margin at a sheet end, that is, performing so-called "marginless printing." The apparatus uses a suction platen that sucks a sheet by a negative pressure.

According to the invention disclosed in Japanese Patent Laid-Open No. 2006-021475, in a case where marginless printing is performed at the trailing end of a sheet, the sheet is sucked to a sucking unit of a platen. In contrast, in a case where marginless printing is performed at the leading end of a sheet, the leading end of the sheet has not yet reached the sucking unit, and therefore, it has not yet sucked to the sucking unit. Thus, the floating of the leading end of the sheet cannot be suppressed at the time of the introduction of the sheet, and thus, ink is landed on the sheet that remains floating. As a consequence, there is a possibility that the quality of an image is reduced at the floating portion of the sheet or the sheet smears due to the contact of the sheet with a printhead. Furthermore, ink discarded outside of the end of a sheet may float in the form of atomized ink mist during the marginless printing, thereby adhering to the reverse of the sheet.

SUMMARY OF THE INVENTION

An object of the present invention is to provide a printing apparatus capable of securely performing marginless printing with respect to sheets having various kinds of sizes, and a platen.

According to one aspect of the present invention, in a printing apparatus comprising: a printhead configured to eject ink; a sheet conveying unit configured to convey a sheet in a first direction, and a platen configured to support the sheet to be printed under the printhead, the platen comprising: a plurality of supporting portions, arranged in a second direction perpendicular to the first direction, each configured to support the sheet; a plurality of negative pressure chambers, disposed under the supporting portions and arranged in the second direction, each configured to supply a negative pressure to each of the supporting portions; and an ink receiver configured to receive ink ejected from the printhead to the outside of the sheet supported by the supporting portions.

According to the present invention, marginless printing can be securely performed with respect to sheets having various kinds of sizes.

Further features of the present invention will become apparent from the following description of exemplary embodiments (with reference to the attached drawings).

DESCRIPTION OF THE EMBODIMENTS

Descriptions will be given below of embodiments of a printing apparatus according to the present invention. Hereinafter, the present invention will be described by way of an inkjet printing apparatus of a serial type for performing printing by reciprocating a printhead capable of ejecting ink in a direction transverse a sheet conveyance direction with respect to a sheet that is intermittently conveyed in a predetermined direction (hereinafter referred to as a printing apparatus). The present invention is applicable to not only a printing apparatus of a serial type but also a line printing apparatus for sequentially performing printing by the use of an elongated printhead. Moreover, the printing apparatus is applicable to not only a printing apparatus having a single function but also a multiple function printer equipped with a copying function, a facsimile function, and the like.

Figure 1:
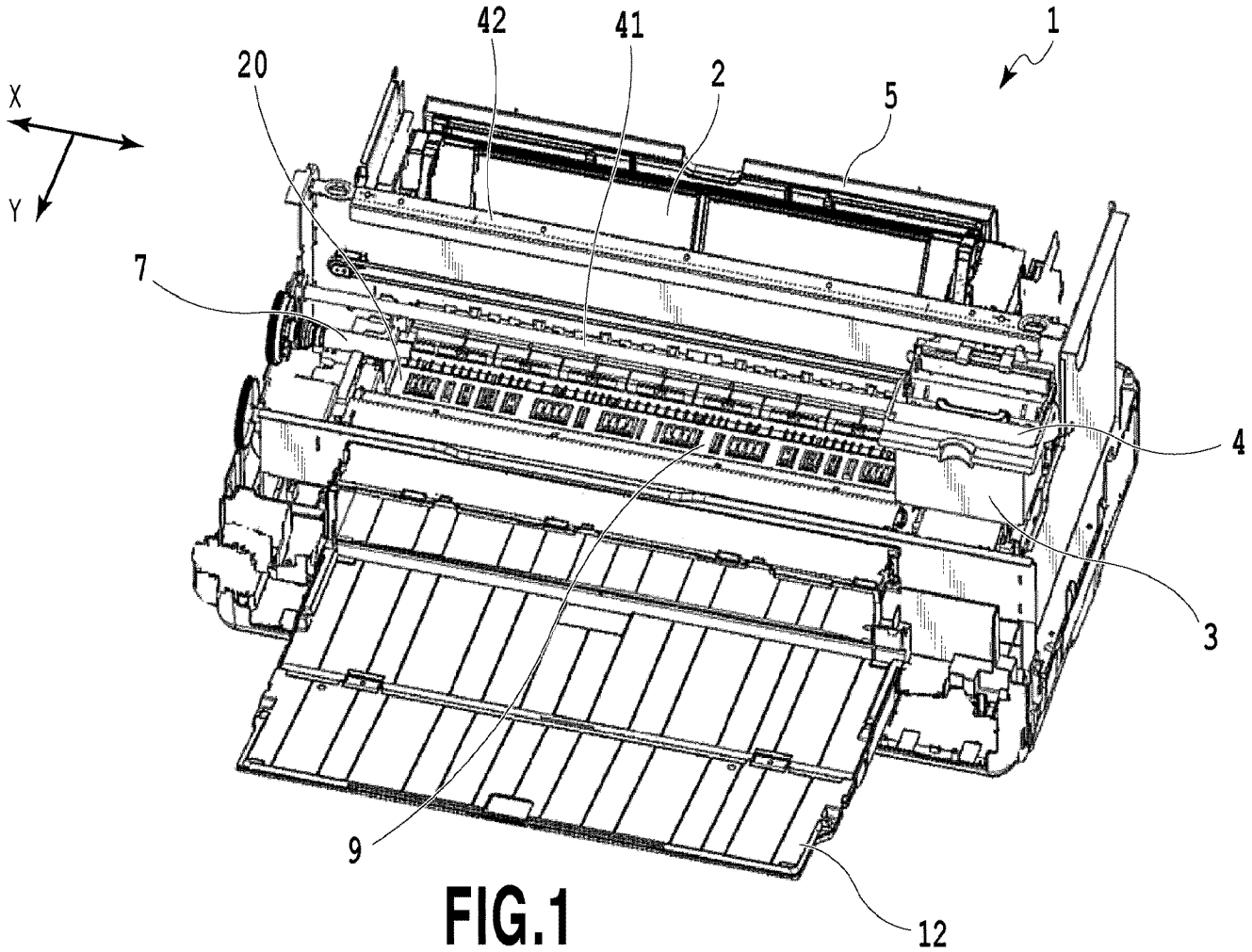
FIG. 1 is a perspective view showing the entire configuration of a printing apparatus.
Figure 2:
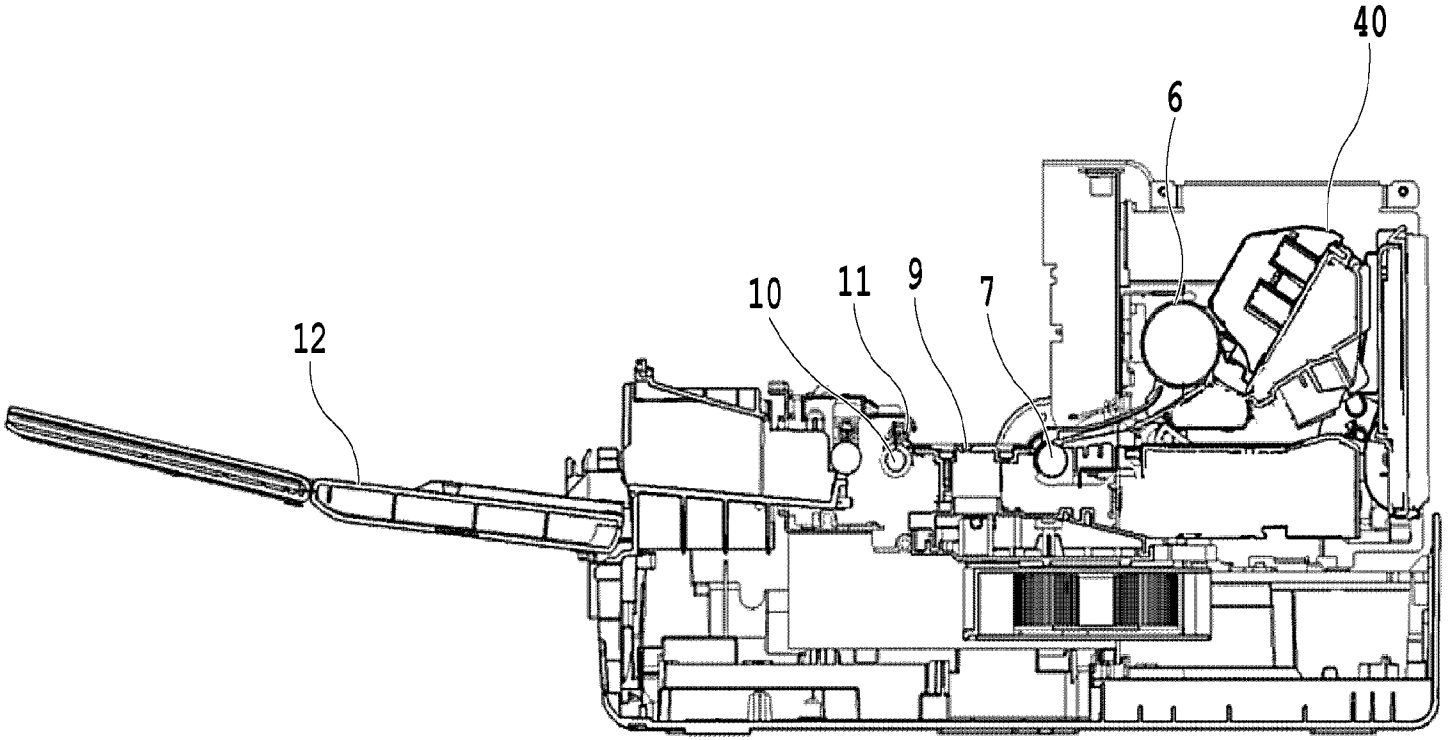
FIG. 2 is a vertical side view showing the printing apparatus.

Explanation will be made on the configuration of a printing apparatus 1. FIG. 1 is a perspective view showing the entire configuration of the printing apparatus 1; and FIG. 2 is a vertical side view showing the printing apparatus 1 shown in FIG. 1. A feeder 40 is disposed at the back of the printing apparatus 1. The feeder 40 separates a bundle of cut sheets (hereinafter simply referred to as sheets) stacked on a feed tray 5 one by one according to the rotation of a feed roller 6, and then, feeds them to a conveyor such as a conveyance roller 7. In addition, a carriage 4 mounting thereon a printhead 3 capable of ejecting ink is disposed at the printing apparatus 1. The carriage 4 is supported in a freely reciprocating manner along a carriage guide shaft 41 and a carriage rail 42 disposed in a direction (i.e., an X direction) transverse (perpendicularly in the embodiment) to a sheet conveyance direction (i.e., a Y direction). The X direction represents the carriage movement direction, and furthermore, is a sheet widthwise direction of the sheet to be conveyed. The direction represents the sheet conveyance direction.

One sheet separated and fed from the bundle of sheets stacked on the feed tray 5 by the feeder 40 is conveyed onto a platen 9 supporting the sheet in a manner facing the printhead 3 by a first conveyance roller pair (i.e., the conveyor) consisting of the conveyance roller 7 and a pinch roller 8. Here, the carriage 4 mounting the printhead 3 thereon is moved in the X direction, and then, ink is ejected toward the sheet from the printhead 3. A carriage sensor for detecting the end of the sheet is disposed at one side surface of the carriage 4. The size of the sheet, the relative position between the sheet and the printhead, and a print starting timing with respect to the sheet are determined based on a detection output from the carriage sensor.

Upon completion of printing of one scanning with respect to the sheet, the sheet is conveyed by a predetermined distance in the Y direction by the first conveyance roller pair. The repetition of the movement of the printhead 3 and the conveyance of the sheet achieves serial printing on the sheet in a serial printing system.

A printed sheet is discharged onto a discharge tray 12 by a second conveyance roller pair (i.e., a conveyor) consisting of discharge rollers 10 and a pulley and disposed downstream of the platen 9 in the sheet conveyance direction (i.e., the Y direction).

1.1 Platen

Figure 5:
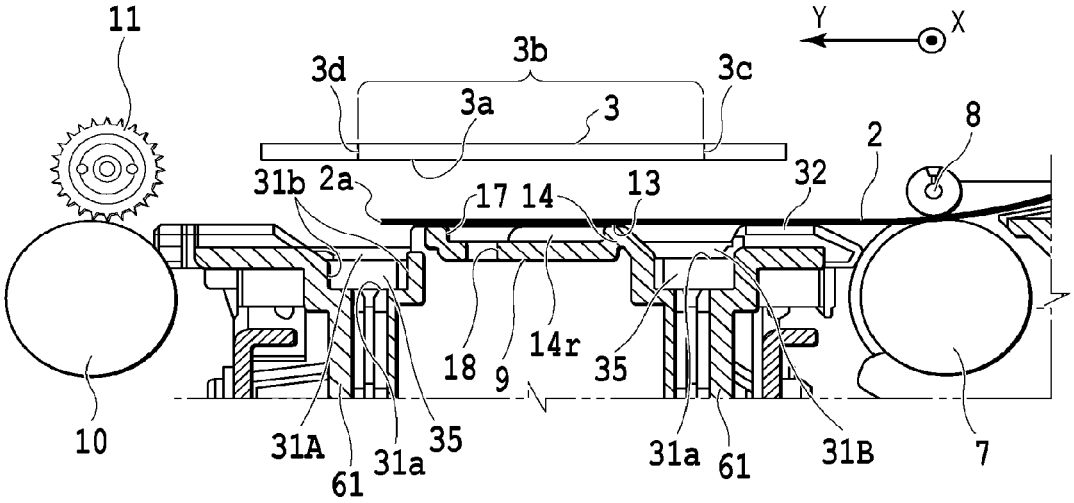
FIG. 5 is a vertical side view showing the platen.

Next, explanation will be made on the structure of the platen 9. As shown in FIGS. 2 and 5, the platen 9 is interposed between the first conveyance roller pair consisting of the conveyance roller 7 and the pinch roller 8 and the second conveyance roller pair consisting of the discharge rollers 10 and the pulley 11. The platen 9 is disposed at a position facing an ejection port forming surface 3*a* of the printhead 3 having ejection ports for ejecting ink arrayed thereon, and supports the sheet to be conveyed by the first and second conveyance roller pairs on a side (i.e., a reverse) opposite to a side to be printed that faces the ejection port forming surface 3*a*. Incidentally, in FIG. 5, reference numeral 3*b* designates an ejection port array formed at the ejection port forming surface 3*a*; 3*c*, a most upstream ejection port at the ejection port array; and 3*d*, a most downstream ejection port at the ejection port array.

Figure 3:
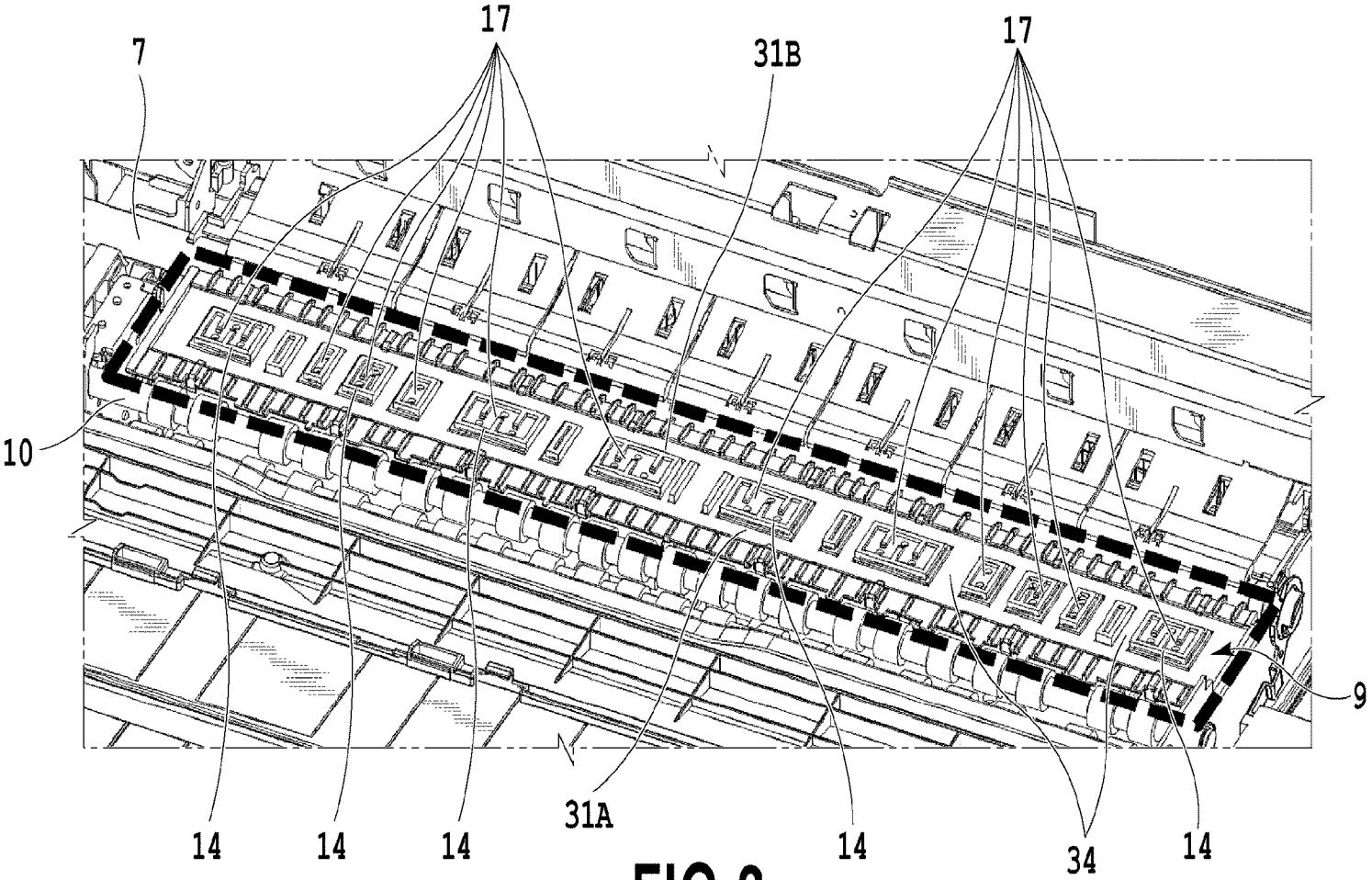
FIG. 3 is a perspective view showing a platen, as viewed sideways from the top.

FIG. 3 is a perspective view showing the platen 9 shown in FIG. 1, as viewed sideward from the top. In FIG. 3, the platen 9 is provided with a sheet supporting portion capable of supporting the reverse of the sheet while suppressing floating or flexure of the sheet in order to properly keep the interval between the ejection port forming face 3*a* of the printhead 3 and the sheet. The plurality of sheet supporting portions 14 are formed in the longitudinal direction (i.e., the X direction) of the platen 9 so as to cope with a plurality of kinds of sheet widths.

Specifically, as to a plurality of sheets having standard sizes, the sheet supporting portion 14 is disposed in such a manner as not to be positioned within a range of about 2 mm from the side end of the sheet during the conveyance of each of the sheets. In the platen 9 in the present embodiment, the arrangement and shape of the sheet supporting portion 14 are determined according to the sheet width of each of sheets such as an L size, a KG size, a 2L size, a 6P size, a letter size, an A4 size, a 4P size, an A3 size, an A3 elongation size, an HP size, an A2 size, an A2 elongation size, and a 17-inch size.

The arrangement of the sheet supporting portion needs to be determined with reference to a print position. In the present embodiment, the reference of the print position is set at the center of the width of a print sheet: namely, a so-called center reference sheet supply is adopted. In the case of the center reference, the sheet is conveyed such that the center of the sheet width (i.e., a print width) matches the center of the platen 9 in the widthwise direction in a case where the sheet has any one of various sheet widths. The sheet supporting portions 14 are disposed at symmetric positions with reference to the center position of the width of the platen 9 in the X direction. Incidentally, other than the center reference, a one-side reference may be adopted such that all sheets having various kinds of sizes are aligned at one of right and left reference positions.

Figure 4:
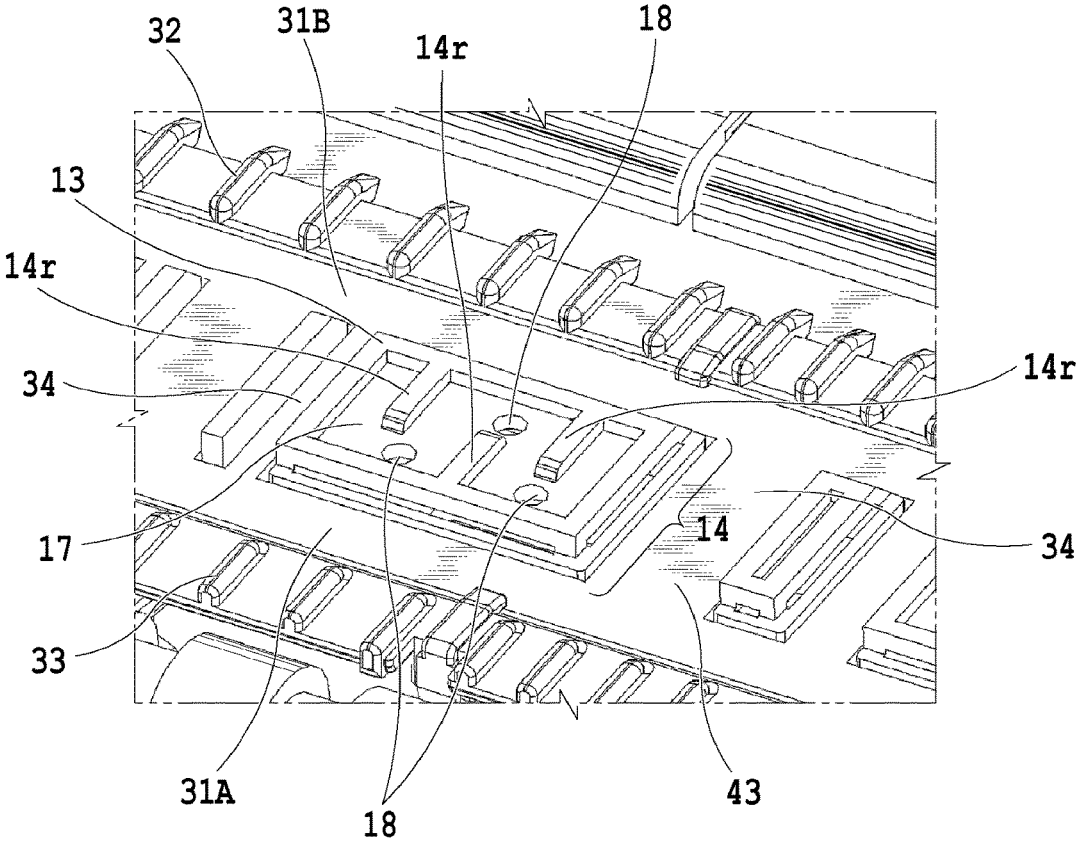
FIG. 4 is an enlarged view partly showing the platen.

FIG. 4 is an enlarged perspective view showing the detailed shape of the sheet supporting portion 14. The sheet supporting portion 14 is obtained by forming, into a rectangular frame, a ribbed projection having a flat sheet supporting surface 13 in contact with the reverse of a sheet. A suction recess (i.e., a suction unit) 17 is formed inside of the sheet supporting portion 14 in such a manner as to be lower by one step than the sheet supporting surface 13. Suction holes 18 penetrating from the obverse of the suction recess 17 to the reverse thereof are formed at the suction recess 17. In order to prevent a sheet from denting at the suction recess 17, intermediate ribs 14*r*, each having a supporting surface flush with the sheet supporting surface 13, are formed at the suction recess 17. It is desirable that the surface of the intermediate rib 14*r* should be continuous to the sheet supporting surface 13 and should extend in the sheet conveyance direction (i.e., the Y direction).

Next, a description will be given of the configuration of an ink receiver formed at the platen 9. Around the sheet supporting portion 14 are formed ink receiver that receives ink elected to the outside of the sheet 2. It is necessary to eject ink up to the outside of the ends of the sheet so as to securely perform printing over the entire sheet without any margins at the peripheral edges of the sheet, that is, so-called marginless printing. In the printing apparatus of the inkjet system, in order to stabilize the ink ejection performance of the printhead 3, ink is ejected to the outside of the sheet immediately before a printing operation, that is, a so-called preliminary ejection is performed. The above-described ink elected to the outside of the sheet is received in the ink receiver formed at the platen 9.

Figure 14A:
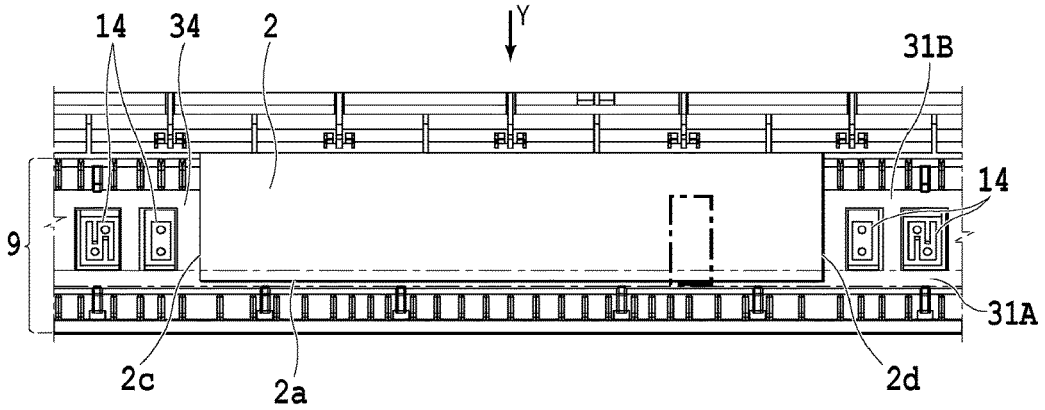
FIGS. 14A and 14B is a plan view showing the positional relationship between a sheet that is being printed and the platen.
Figure 14B:
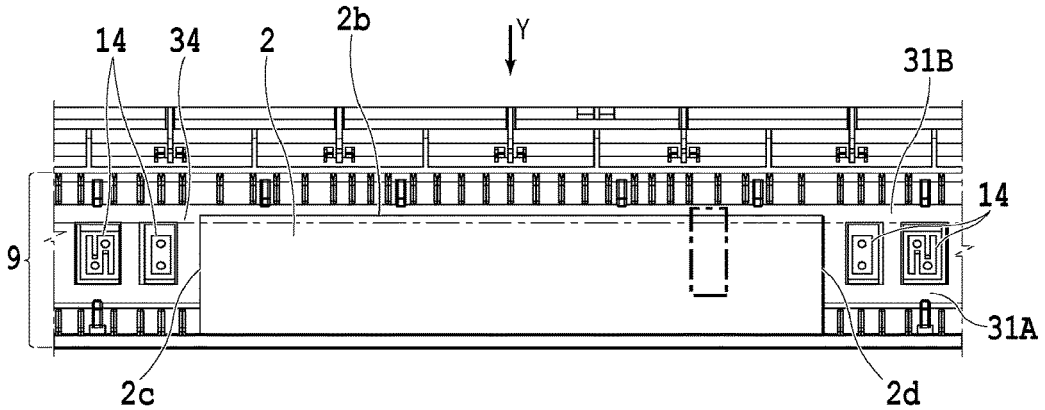

As shown in FIGS. 3 and 4, the ink receiver includes a leading end ink discarding groove 31A that receives ink ejected to the outside of a sheet leading end 2*a* (see FIG. 5) and a trailing end ink discarding groove 31B that receives ink ejected to the outside of a sheet trailing end 2*b* (see FIG. 14B). The leading end ink discarding groove 31A is elongated in the X direction adjacently downstream of the sheet supporting portion 14 while the trailing end ink discarding groove 31B is elongated in the X direction adjacently upstream of the sheet supporting portion 14. Moreover, the ink receiver includes right/left end ink discarding grooves 34 that receive ink ejected to the outside of right and left ends (sheet side ends) of the sheet 2 in the sheet widthwise direction. The right/left end ink discarding grooves 34 extend in the Y direction, and connect the upstream ink discarding groove 31B and the downstream ink discarding groove 31A. As described above, the leading end ink discarding groove 31A, the trailing end ink discarding groove 31B, and the right/left end ink discarding grooves 34 are formed in a grid manner at the surface of the platen 9.

FIG. 5 is a vertical side view partly showing the platen 9, and shows the cross sections of the leading end ink discarding groove (i.e., a first ink receiver) 31A and the trailing end ink discarding groove (i.e., a second ink receiver) 31B. Each of the leading end ink discarding groove 31A and the trailing end ink discarding groove 31B is defined by a bottom 31*a* lower than the sheet supporting surface 13 and side walls 31*b*, and is formed into a shape that can temporarily reserve the received ink therein.

In this manner, assuming that the marginless printing is performed on four sides of a cut sheet, the sheet supporting portion 14 of the platen 9 is individually surrounded by the fore and trailing end ink discarding grooves 31A and 31B and the right/left end ink discarding grooves (i.e., a third ink receiver) 34. Moreover, an ink absorber 35 is disposed at each of the ink discarding grooves so as to receive the ejected ink and hold the received ink without any leakage. It is preferable that the ink absorber 35 should be made of a spongy single sheet material such as expanded urethane. Since the ink absorber is made of the above-described material having ink absorbency, the ink absorber 35 can securely receive the ink ejected from the printhead 3, and then, introduce the ink to an ink discharge port while being permeated with the received ink and holding it therein.

1.2 Air Channel

Figure 6:
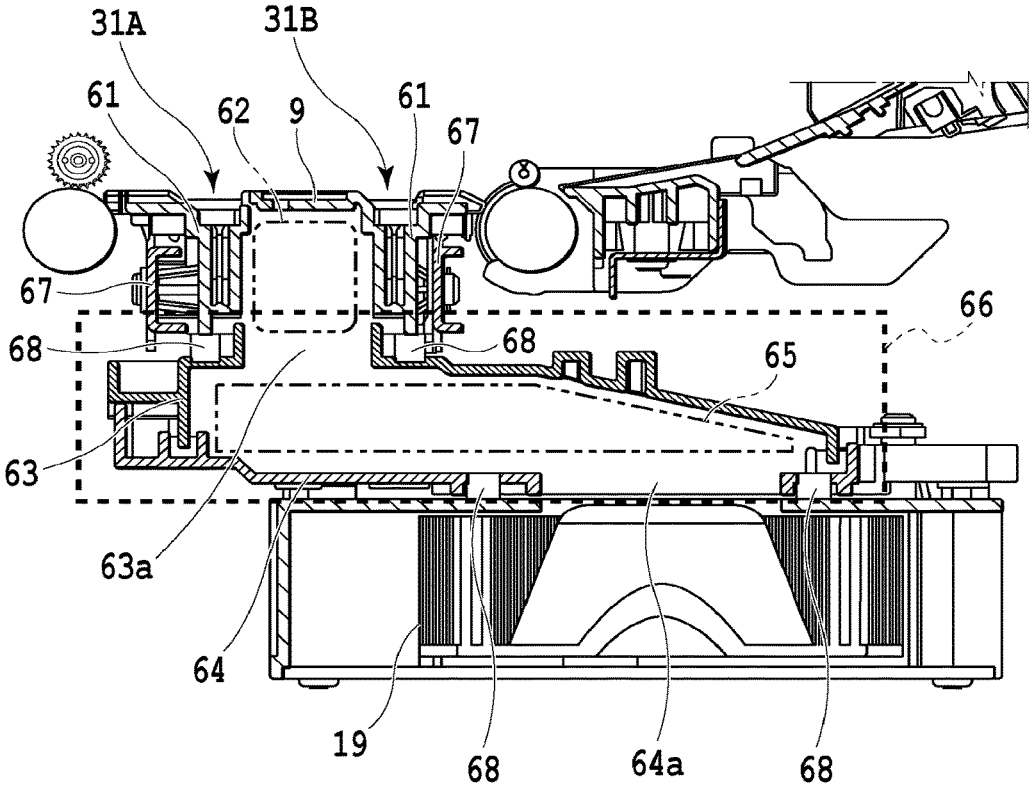
FIG. 6 is a vertical side view showing an air channel.
Figure 7:
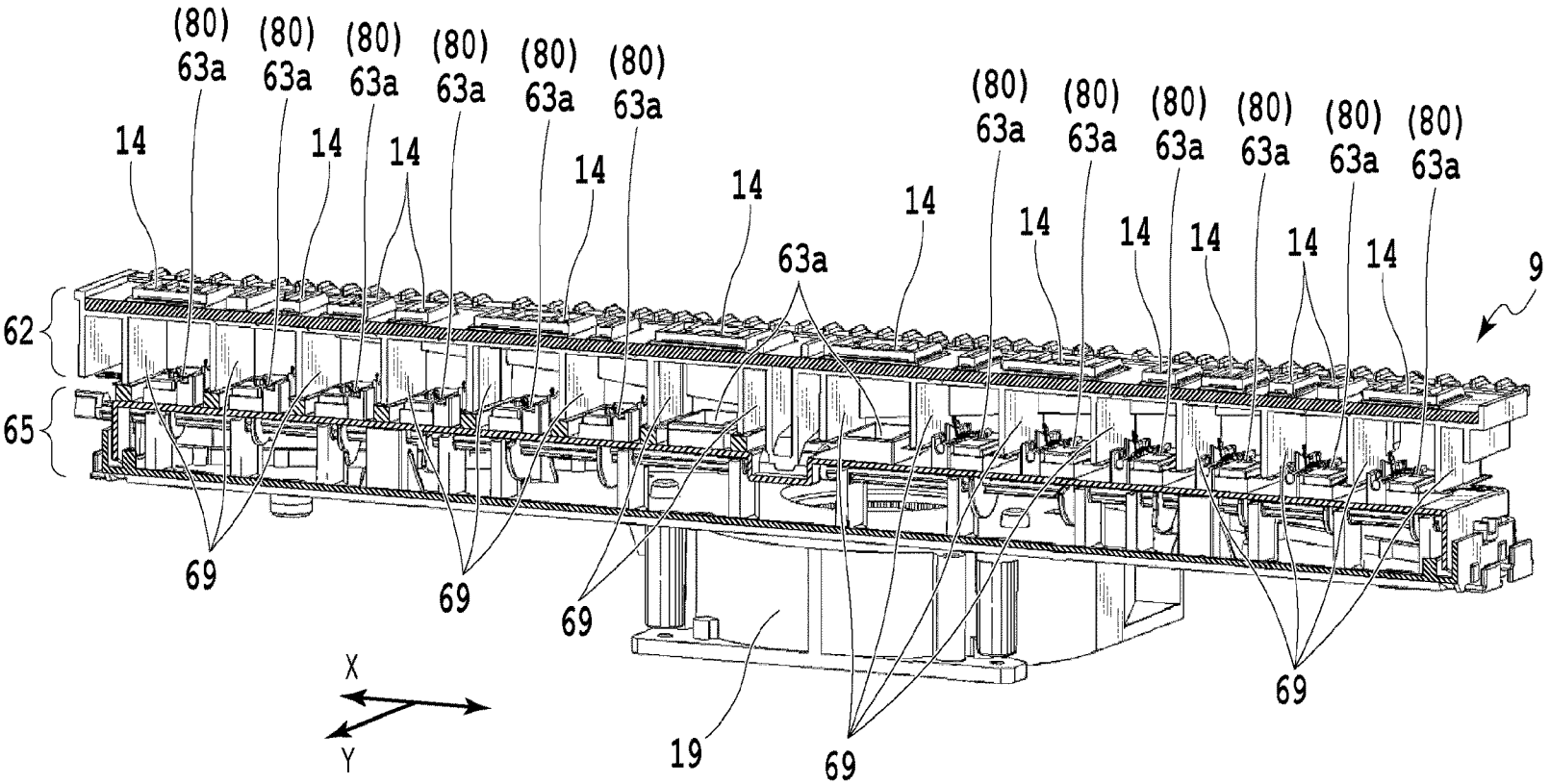
FIG. 7 is a perspective view showing the inside structure of the platen.

FIG. 6 is a vertical side view showing an air channel from the platen 9 disposed inside of the printing apparatus 1 to a suction fan 19; and FIG. 7 is a perspective view showing the inside structure of the platen 9. Right under the platen 9 is disposed a duct 66 having a cavity therein, wherein the duct 66 includes a cover member 63 having a plurality of first openings 63*a* formed thereon and a base member 64 having a second opening 64*a* formed at the lower surface thereof.

The platen 9 is provided, at its lower section, with an outer peripheral wall 61 that surrounds therearound and a plurality of partition walls 69 that partition a space defined by the outer peripheral wall 61 into a plurality of small spaces. The outer peripheral wall 61 and the partition walls 69 engage the upper surface of the cover member 63 in such a manner as to encompass each of the plurality of first openings 63*a* formed at the cover member 63, thus defining a plurality of first negative pressure chambers 62.

Moreover, each of the first negative pressure chambers 62 corresponds to one or two sheet supporting portions 14 disposed at the platen 9. Here, each of the first negative pressure chambers 62 is disposed right under the one or two corresponding sheet supporting portions 14 (see FIG. 7). As shown in FIG. 6, the single first opening 64*a* is formed at the lower surface of the base member 64, and matches a suction port formed at the suction fan 19 serving as a negative pressure generating unit in such a manner as to encompass the first opening 64*a*. In this manner, a single second negative pressure chamber 65 is formed inside of the duct 66. The second negative pressure chamber 65 communicates with the plurality of first negative pressure chambers 62 via the plurality of first openings 63*a*. The first negative pressure chambers 62 and the second negative pressure chamber 65 form air channels from the suction holes 18 formed at the platen 9 to the suction fan 19.

Here, seal members 68 for suppressing any leakage of air are disposed at a portion at which the bottom of each of the outer peripheral wall 61 and partition walls 69 of the platen 9 is fitted to the upper surface of the cover member 63 and a portion at which the second opening 64*a* of the base member 64 matches the suction fan 19, respectively. It is preferable that the seal member 68 should be formed of soft expanded rubber or the like that has high sealability and is made of EPDM such that the platen 9 or the cover member 63 cannot be deformed by the repulsive force of the seal member 68 at the time of compression. The seal member 68 is interposed between members, thus suppressing the transmission of vibrations from the suction fan 19 to the platen 9 while keeping the sealability between the members.

Incidentally, the platen 9 is supported by platen chassis 67 disposed upstream and downstream thereof. The platen chassis 67 are fixed to a body chassis, not shown, for supporting the conveyance roller 7 or the carriage 4. The duct 66 is secured to the body chassis via the platen chassis 67.

It is preferable that the suction fan 19 serving as the negative pressure generator should be a sirocco fan or the like having an excellent suction efficiency. The suction air rate of the suction fan 19 can be adjusted under a PWM control. The suction air rate is variable according to the type of sheet, the state of a sheet, and use atmospheric environment, thereby adjusting the suction of the sheet.

Here, the platen 9 is formed into a single resin-molded component part. All of the sheet supporting portions 14, the plurality of the first negative pressure chambers 62, and the ink receivers (i.e., the first to third ink receiver) are aggregated into a single resin-molded component part that forms the platen 9. In this manner, it is possible to simplify the fabrication of the printing apparatus, and furthermore, enhance the accuracy of relative positions among functional component parts.

1.3 Opening/Closing Valve

As shown in FIG. 7, a first opening/closing valve 80 is disposed at all of the first openings 63*a* except the two openings at the center in the sheet widthwise direction (i.e., the X direction) out of the plurality of first openings 63*a* formed on the above-described air channels.

Figure 8A:
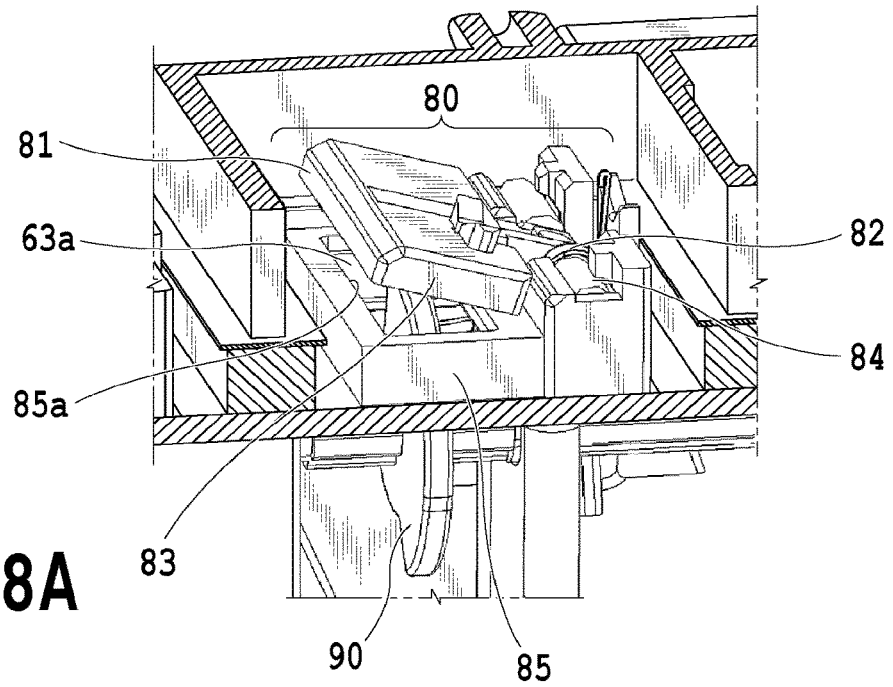
FIGS. 8A and 8B are enlarged perspective views showing an opening/closing valve disposed in the platen.
Figure 8B:
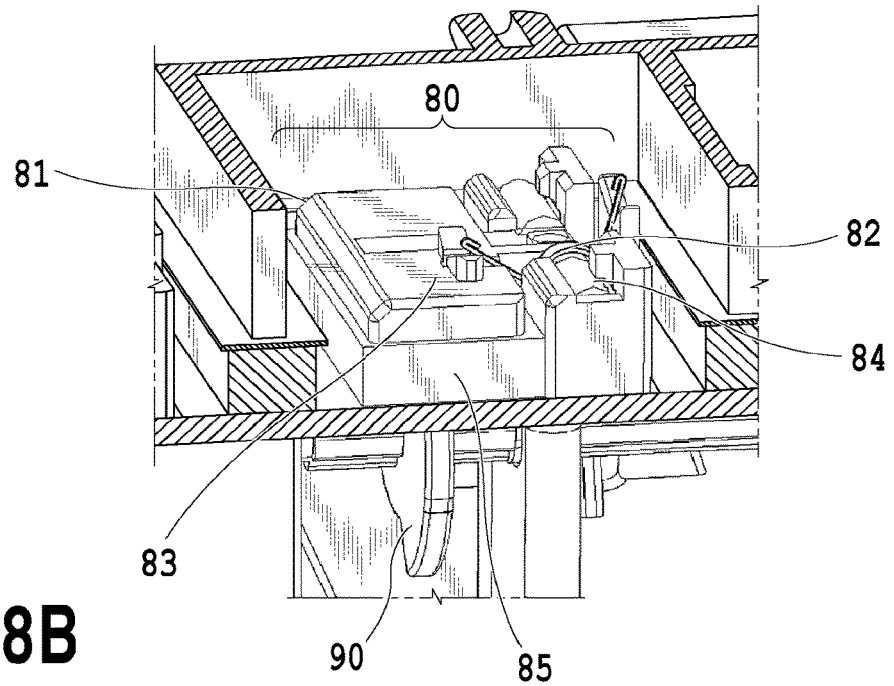

FIGS. 8A and 8B are perspective views showing the configuration of one opening/closing valve 80 disposed at the first opening 63*a*. In FIGS. 8A and 8B, the opening/closing valve 80 includes a valve plate 81, a plate pressing spring 82, and a cam 90. The valve plate 81 includes a plate-like member 83, a cam follower, not shown, and a rotary shaft 84. The valve plate 81 is turnably supported by the rotary shaft 84 in such a manner as to open or close an opening 85*a* formed at a bank 85 of the duct, formed around the first opening 63*a*, and is urged by the resilient force of the plate pressing spring 82 in a direction in which the opening 85*a* at the bank 85 is closed. The cam follower abuts against the cam 90 to separate the valve plate 81 from the bank 85 against the resilient force of the plate pressing spring 82, thus bringing the opening/closing valve 80 into an open state shown in FIG. 8A. In contrast, in a case where the cam follower is separated from the valve plate 81 by the cam 90, the valve plate 81 is depressed by the resilient force of the plate pressing spring 82, thereby brining the opening/closing valve 80 into a closed state shown in FIG. 8B.

Figure 9:
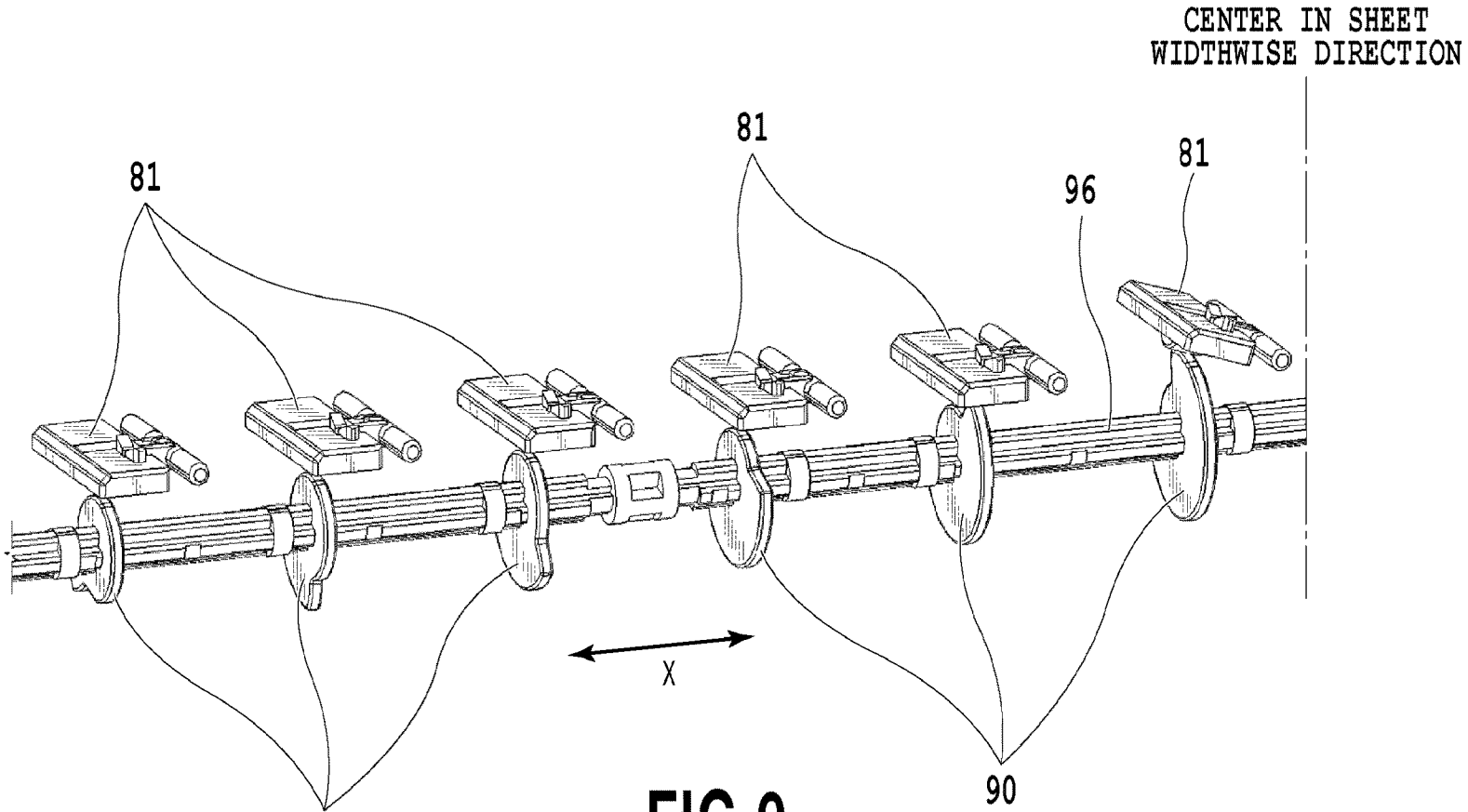
FIG. 9 is a perspective view showing cams that drive the opening/closing valves.

FIG. 9 is a view showing the arrangement of the cams 90 disposed in a manner corresponding to the plurality of valve plates 81. FIG. 9 partly shows the cams 90 and the valve plates 81 positioned on one side (i.e., left) of the center in the sheet widthwise direction (i.e., the X direction) of the platen 9. The cam 90 is a disk cam, and is disposed inside of the second negative pressure chamber 65. The plurality of disc cams 90 are fixed to a common shaft 96 in such a manner as to be coaxially rotated. Moreover, the cams have cam faces having different cam phases from each other such that the opening/closing valves nearer the center in the sheet widthwise direction, that is, the center of the platen 9 are brought into the open state in order. Although not shown in FIG. 9, the cams 90 and the valve plates 81 on a reverse (right) side of the center in the sheet widthwise direction are configured in the same manner.

Figure 10:
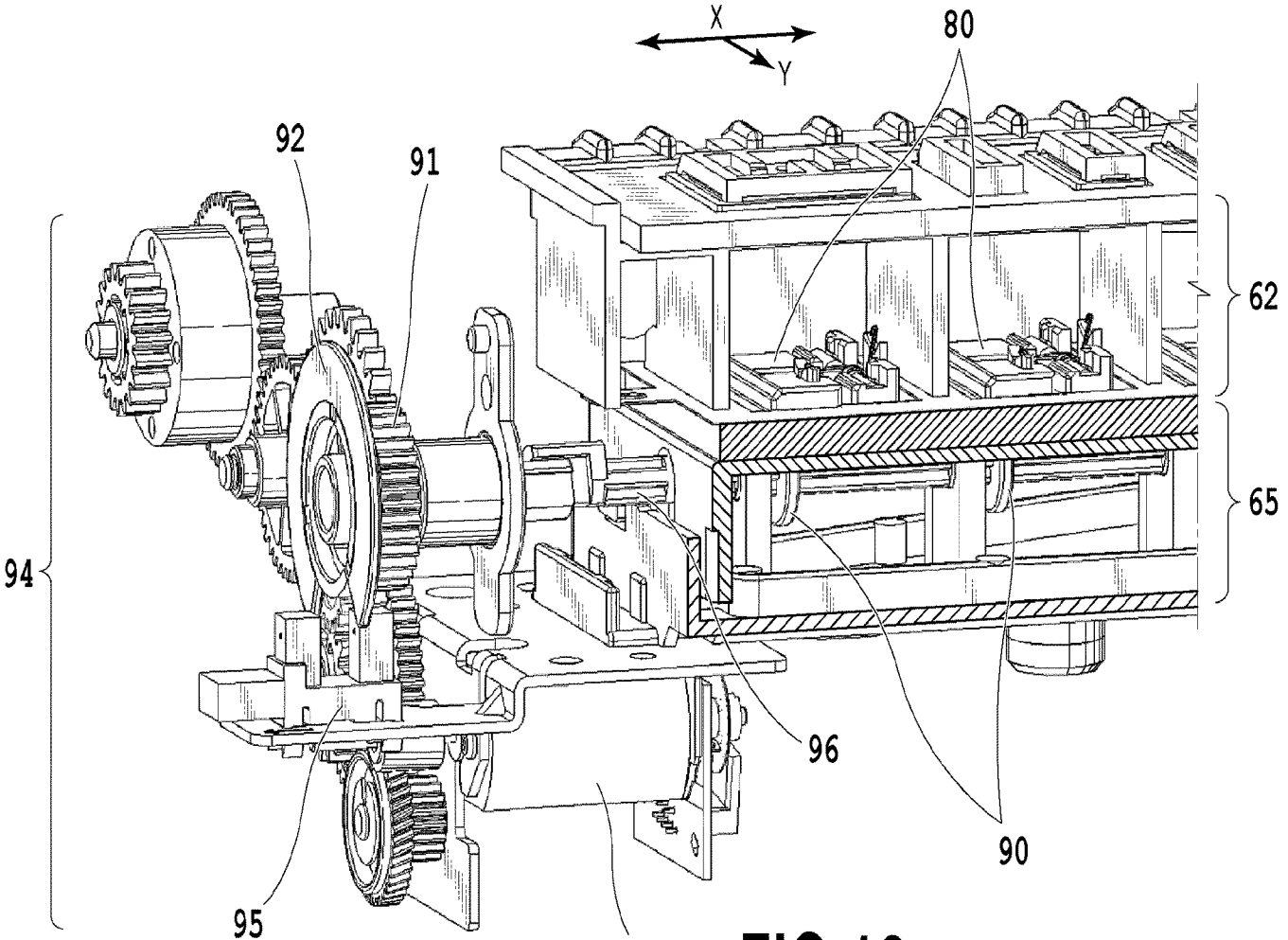
FIG. 10 is a perspective view showing a drive mechanism for the cams.

FIG. 10 is a perspective view showing a drive mechanism for the cams 90. The shaft 96 penetrates the wall of the second negative pressure chamber 65, and then, engages with a cam gear 91 positioned outside of the second negative pressure chamber 65. To the cam gear 91 is transmitted rotation of a drive shaft of a cam drive motor 93 via a gear train 94. A flange 92 having a cutout partly formed in a circumferential direction is attached to the cam gear 91. The cam 90 is positioned at its initial phase at a timing when a photosensor 95 detects the cutout at the flange 92. The cam drive motor 93 is provided with a rotary encoder. The rotational amount of the drive shaft of the cam drive motor 93 is controlled based on an output from the rotary encoder, thus rotating or stopping the cam 90 in such a manner as to position the cam 90 at a desired rotational phase.

The above-described first opening 63*a*, opening/closing valve 80, and cam 90 disposed at each of the negative pressure chambers and a drive mechanism for the cam 90 configure an adjusting unit that individually adjusts the supply of the negative pressure to the plurality of negative pressure chambers.

1.4 Control System

Figure 11:
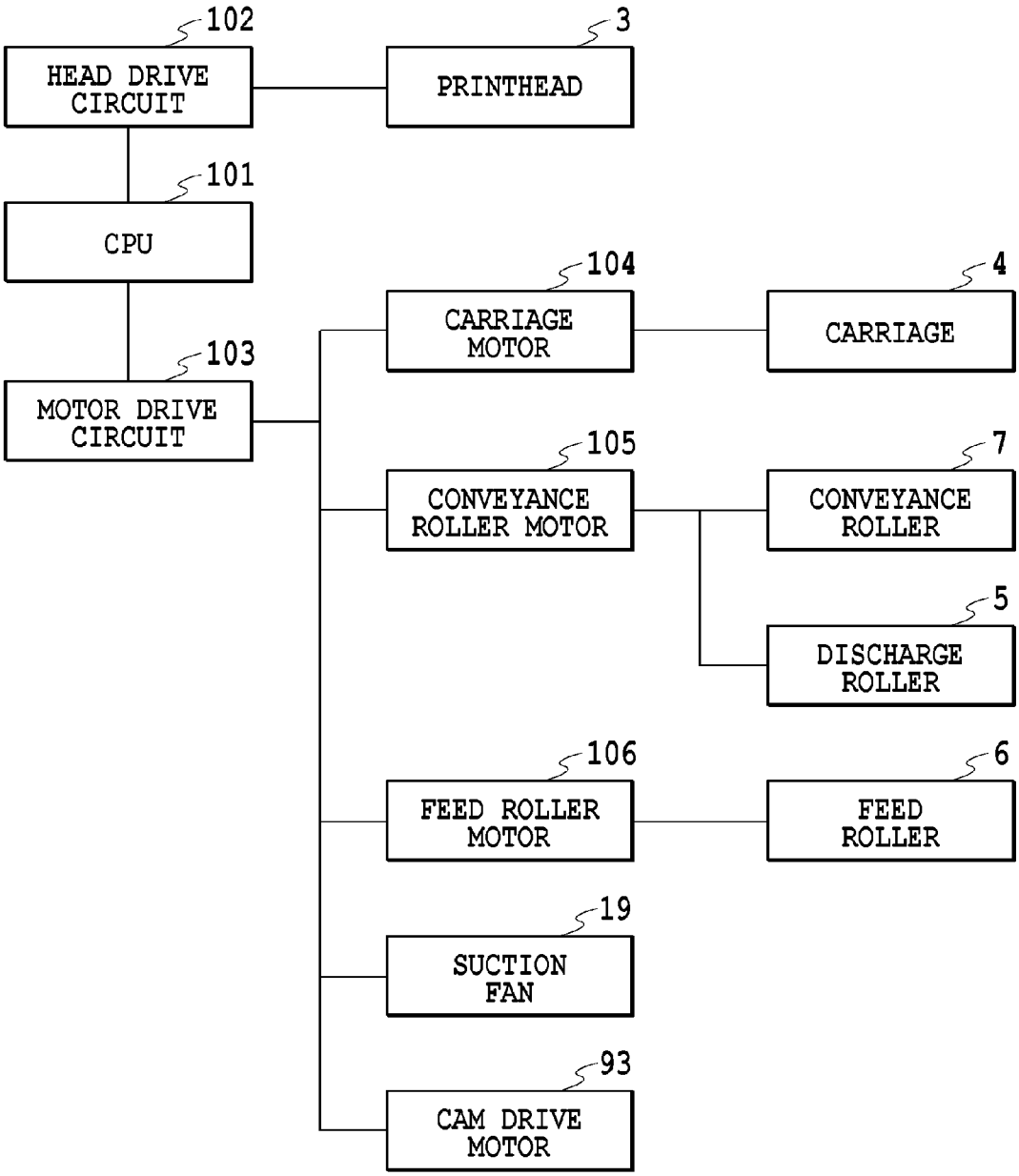
FIG. 11 is a block diagram illustrating the configuration of a control system.

FIG. 11 is a block diagram illustrating the configuration of a control system of the printing apparatus 1. To a CPU 101 is connected a head drive circuit 102 for controlling the ink ejection by the printhead 3. Furthermore, to the CPU 101 is connected a motor drive circuit 103 for controlling motors for actuating the mechanisms (a carriage motor 104, a conveyance roller motor 105, a feed roller motor 106, the suction fan 19, the cam drive motor 93, etc.) and the like.

The motor drive circuit 103 can perform the PWM control, thus adjusting the air rate of the suction fan 19 so as to adjust a suction negative pressure at a sheet sucking unit. A change in air rate according to the type of sheet, the state of a sheet, and an atmospheric environment condition is effective in adjusting sheet conveyance performance. The air rate may be changed according to the position of the carriage 4 and a sheet conveyance position.

1.5 Printing Operation

Figure 12:
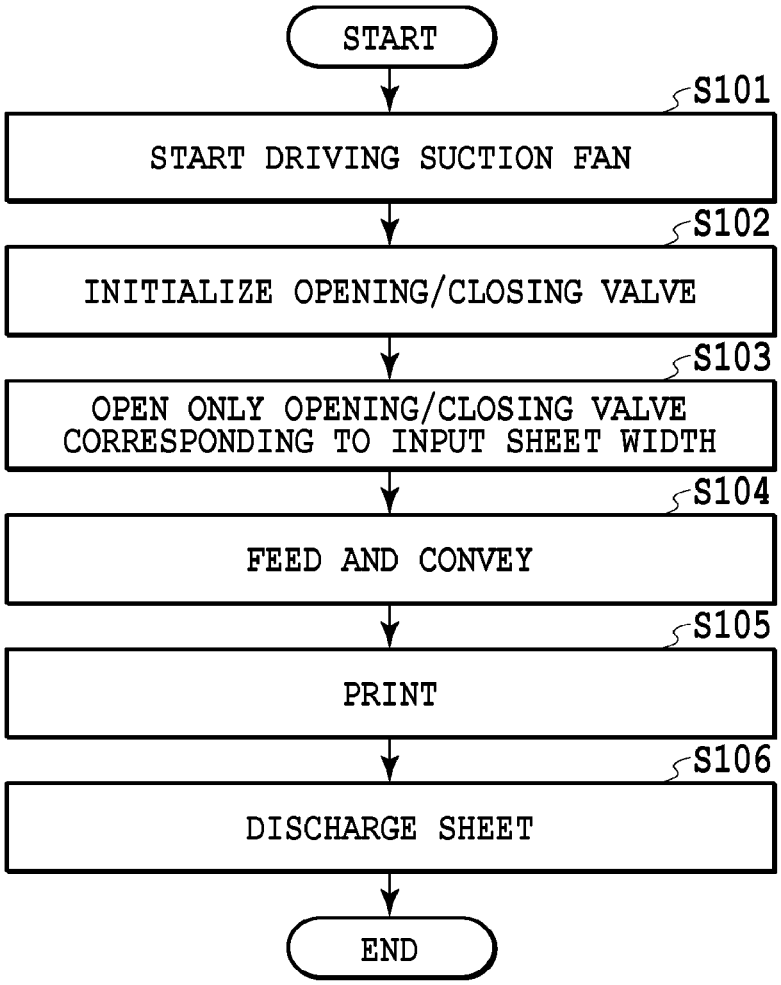
FIG. 12 is a flowchart illustrating a control operation.
Figure 13:
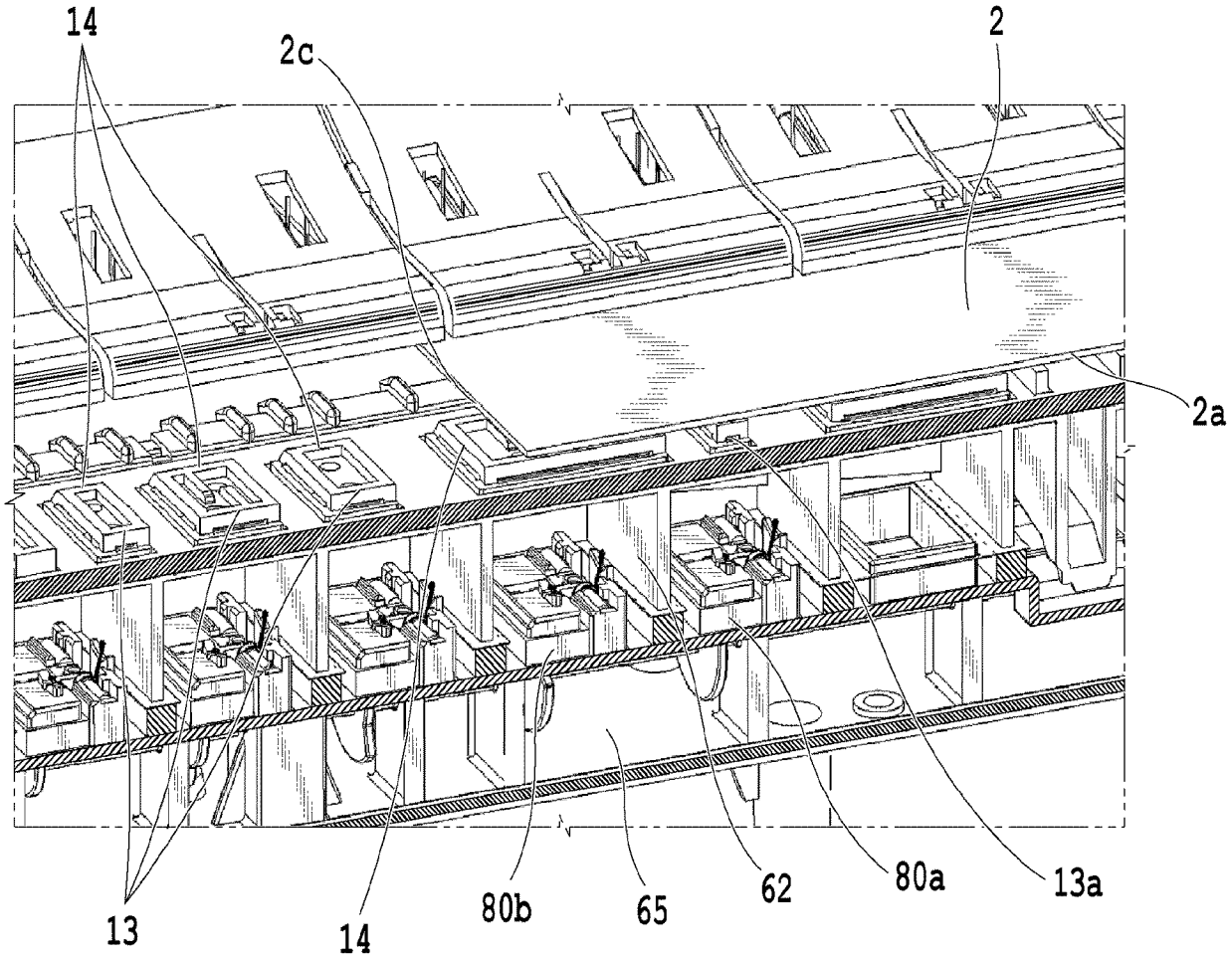
FIG. 13 is a partly cross-sectional perspective view showing the positional relationship between a sheet and a sheet supporting portion.

Next, explanation will be made on a printing operation in the printing apparatus 1 with reference to FIGS. 13, 14A, and 14B. The CPU 101 in the printing apparatus 1 performs a control operation illustrated in a flowchart of FIG. 12 upon receipt of a print command including sheet size information from a host computer installed outside. First, the CPU 101 controls the motor drive circuit 103 so as to drive the suction fan 19 (S101), and furthermore, drives the cam drive motor 93 so as to rotate the cams 90 at the initial phase (S102). At this time, all of the opening/closing valves 80 are brought into a closed state, that is, a state in which communication between the first negative pressure chambers 62 and the second negative pressure chambers 65 is interrupted. Thereafter, the CPU 101 drives the cam drive motor 93 so as to rotate the cams 90 at a phase corresponding to a sheet width of a sheet having an input size, and then, to bring only the opening/closing valves 80 corresponding to the sheet supporting surface 13 that supports the sheet 2 into an open state (i.e., a communication state) (S103). Here, as shown in FIG. 13, in a case where the left end 2*c* of the sheet 2 is positioned inside of the sheet supporting surface 13, an opening/closing valve 80*b* corresponding to the sheet supporting surface 13 comes into a closed state. In other words, the CPU 101 controls the cam drive motor 93 so as to bring only an opening/closing valve 80*a* corresponding to a sheet supporting surface 13*a* completely covered with the sheet 2 on a side of a right end 2*d* of the sheet 2.

A negative pressure is supplied, by the suction fan 19, to the first negative pressure chamber 62 allowed to communicate with the second negative pressure chamber 65 by the opening/closing valve 80*a* that has been brought into an open state. As a consequence, air staying inside of the suction recess 17 is sucked through the suction holes 18 communicating with the first negative pressure chamber 62, to which the negative pressure is supplied, and then, the sheet 2 passing the suction recess 17 is sucked to the sheet supporting portion 14. In this manner, opening or closing the opening/closing valve 80*a* enables the negative pressure to be individually supplied to the plurality of first negative pressure chambers 62. The first negative pressure chambers 62, to which the negative pressure should be supplied, are selected according to the sheet width that has been previously input.

Upon completion of the above-described preparation, the CPU 101 drives the feed roller motor 106 and the conveyance roller motor 105 via the motor drive circuit 103 so as to rotate the feed roller 6 and the conveyance roller 7. As a consequence, a piece of sheet 2 is fed from the feed tray 5 to the conveyance roller 7, and then, the sheet 2 is conveyed, by the conveyance roller 7 that takes charge of the sheet, up to a position at which the sheet 2 covers the sheet supporting surface 13 of the platen 9. With this conveying operation, the leading end 2*a* of the sheet 2 passes between the sheet supporting surface 13 and the printhead 3, and thereafter, the leading end 2*a* of the sheet 2 reaches a position above the leading end ink discarding groove 31A and upstream of the most downstream ejection port 3*d* of the ejection port array 3*b* in the Y direction (see FIG. 14A).

Subsequently, the CPU 101 drives the carriage motor 104 via the motor drive circuit 103 so as to start moving the carriage 4 in the X direction. At the same time, the CPU 101 allows the printhead 3 to eject ink via the head drive circuit 102. In this manner, a printing operation is performed on the sheet 2. In a case where this printing operation is so-called marginless printing in which the entire sheet 2 is printed without any margins at the ends thereof, the ink is ejected to a region from outside to inside of the leading end 2*a* of the sheet 2. In this case, even if the ink is ejected from all of the ejection ports at the ejection port array 3*b*, the ejection port 3*d* positioned most downstream is positioned above the leading end ink discarding groove 31A, so that all the ink ejected to the outside (i.e., downstream) of the sheet 2 is received by the ink absorber 35. Moreover, since the right and left ends 2*d* and 2*c* of the sheet 2 also are positioned above the right/left end ink discarding grooves 34 formed between the sheet supporting portions 14, all the ink ejected to the outside of the sheet 2 is received by the ink absorber 35. Consequently, the sheet supporting surface 13 of the platen 9 is prevented from being smeared with the ink.

Additionally at this time, the suction fan 19 that has been rotated by the above-described preparing operation exhausts the air staying inside of the suction recess 17. Therefore, the suction recess 17 is covered with the sheet 2, whereby the negative pressure is generated in a space from the suction fan 19 to the reverse of the sheet 2. This negative pressure sucks the sheet 2 to the sheet supporting surface 13, thus suppressing floating of the sheet 2 from the sheet supporting surface 13 or flexure of the sheet 2. Consequently, it is possible to keep a constant distance between the ejection port forming surface 3*a* of the printhead 3 and the sheet 2. In this state, printing proceeds on the sheet 2 by repeating the ink ejection by the printhead 3 and the intermittent conveying operation of the sheet 2 (S105).

Thereafter, the trailing end 2*b* of the sheet 2 passes the first conveyance roller pair, and then, a final printing operation is performed in a state in which the trailing end 2*b* of the sheet 2 reaches a position above the trailing end ink discarding groove 31B and downstream of the most upstream ejection port 3*c* in the Y direction, as shown in FIG. 14B. At this time, even if all of the ejection ports at the ejection port array 3*b* are used, all the ink ejected to the outside (i.e., upstream) of the sheet 2 is received by the ink absorber 35, thus properly completing the marginless printing at the trailing end 2*b* of the sheet 2. Thereafter, the rotation of the discharge roller 10 allows the sheet 2 to be discharged onto the discharge tray 12 (S106). Upon completion of the discharge of the sheet 2, the CPU 101 stops driving the suction fan 19 via the motor drive circuit 103.

Here, in a case where sheets having the same size are continuously printed, the cams 90 may not be rotated up to the initial phase (S102) or the suction fan may not be stopped. Moreover, during the printing operation, the suction strength of the suction fan 19 may be varied or drive and stoppage may be switched. The sheet 2 can be sucked by an optimum suction force by changing a drive timing or rotational speed of the suction fan 19, as necessary.

In the meantime, also in the case of so-called border printing in which margins remain along the ends of the sheet 2, the sheet 2 covers the sheet supporting surface 13 all the time during the printing operation. Consequently, the sheet 2 is sucked to the sheet supporting surface 13 by the negative pressure generated at the suction recess 17 formed inside of the sheet supporting portion 14, thus suppressing floating of the sheet 2 from the sheet supporting surface 13 or flexure of the sheet 2. In this manner, even during the border printing operation, it is possible to keep the constant distance between the ejection port forming surface 3*a* of the printhead 3 and the sheet 2.

As described above, since the sheet 2 is placed on the sheet supporting surface 13 of the sheet supporting portion 14 all the time from the beginning of the printing operation to the end thereof, the proper introduction of the negative pressure into the suction recess 17 achieves the printing operation in a state in which the sheet 2 is sucked to the sheet supporting surface 13. Consequently, it is possible to properly keep the distance between the printhead 3 and the sheet 2 so as to enable an ink droplet having an optimum shape to be landed at an optimum position on the sheet 2, thus forming an image of a high quality. In addition, since the opening/closing valves 80 corresponding to the sheet supporting portions 14 positioned outside of the ends of the sheet 2 are closed so as to reduce the generation of air flowing outside of the ends of the sheet 2, thus alleviating drip of the ink droplet toward the ends caused by the air flow. As a consequence, it is possible to properly achieve the marginless printing on the sheets having various kinds of sizes with certainty.

Next, a description will be given of a second embodiment according to the present invention. The opening/closing valve is opened or closed according to the sheet size (i.e., the sheet width) input by the host computer in starting the printing operation in the first embodiment. However, there is a possibility that a sheet has a size different from the input size. In view of this, the present embodiment is designed such that the width of a sheet that is actually fed is automatically detected so as to control whether an opening/closing valve 80 is opened or closed based on the detection result.

Here, explanation will be first made on a sheet width detecting operation that is performed in the present embodiment. A carriage 4 in the present embodiment is provided with an optical sensor at a position opposite to a platen 9. The optical sensor includes an LED serving as a light emitter and a light receiving device serving as a light receiver. The LED emits light toward the platen 9 while the light receiver receives reflected light of the light emitted from the LED, and then, transmits a detection signal according to a light reception intensity to a CPU 101. In a case where a sheet exists right under the light emitter, most of the light emitted from the light emitter is reflected on the sheet, and therefore, most of the light is incident into the light receiver, so that the light receiver outputs a signal of a high level. In contrast, in a case where no sheet exists right under the light emitter, the light reception intensity at the light receiver is remarkably reduced, and thus, the light receiver outputs a signal of a low level. The CPU 101 determines the presence/absence of the sheet right under the optical sensor based on the output signal from the light receiver. The presence/absence of the sheet is determined while the carriage 4 is moved in an X direction, and thus, the sheet width can be detected. In other words, the presence/absence of the sheet is determined based on the detection result of the optical sensor while the carriage 4 is moved. The CPU 101 stores a position A of the carriage 4 at a timing at which the determination is switched from the presence to the absence of the sheet and a position B of the carriage 4 at a timing at which the determination is switched from the absence to the presence of the sheet. As a consequence, the sheet width is determined based on a difference between the stored positions A and B of the carriage 4.

Figure 15:
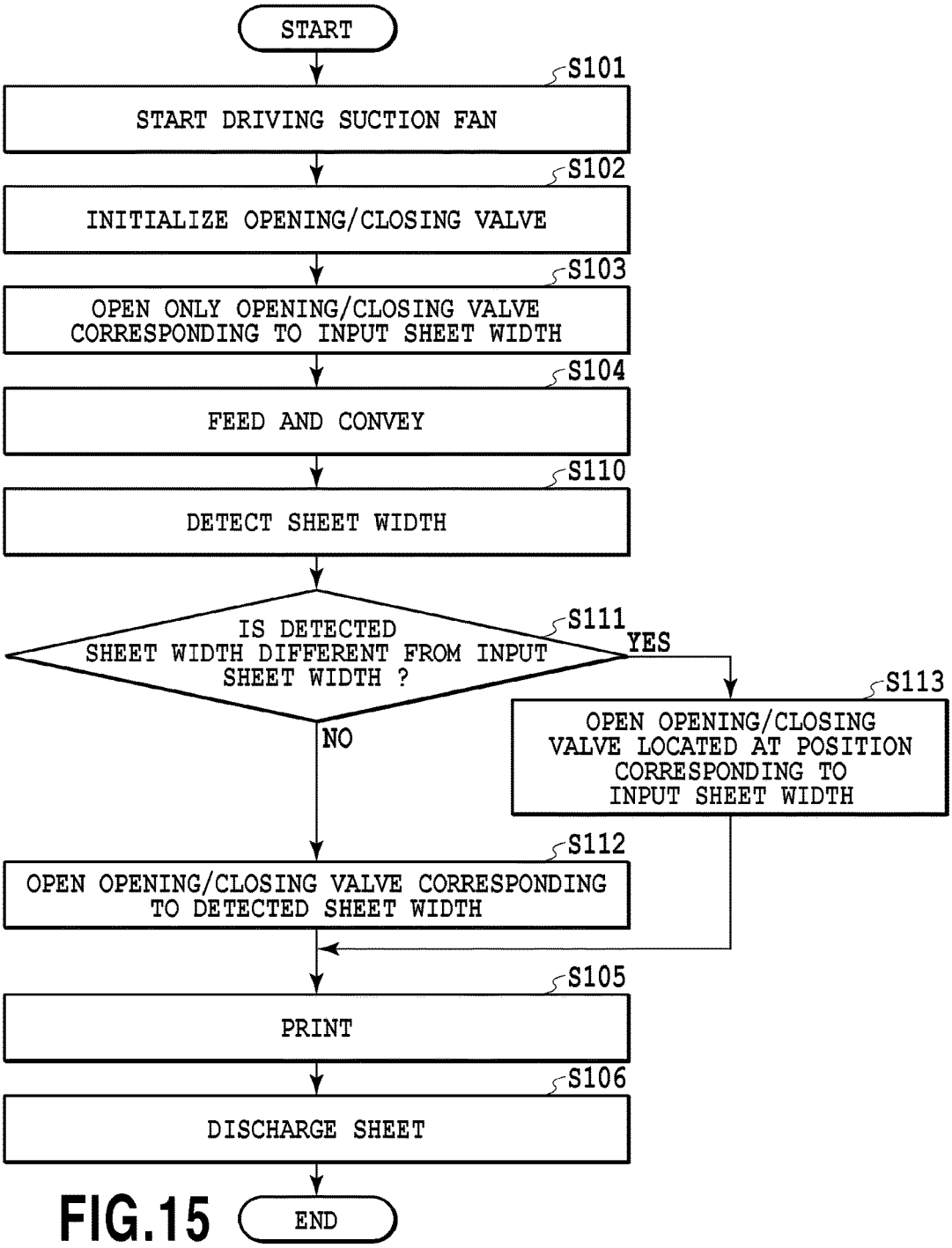
FIG. 15 is a flowchart illustrating a control operation in a second embodiment.

FIG. 15 is a flowchart illustrating a series of printing operations in the present embodiment, wherein the printing operations include the above-described automatic detection of the sheet width. Here, steps S101 to S104, S105, and S106 in FIG. 15 are the same as those in the first embodiment, and therefore, their explanation will be omitted below.

At a timing at which a leading end 2*a* of a sheet 2 fed reaches a predetermined position on the platen 9, the conveyance of the sheet 2 is stopped. Here, the sheet width is detected in the above-described manner (S110). In a case where a difference between the detected sheet width and an input sheet width is a predetermined value or less, it is determined that a sheet having a planned size is fed (S111), thus opening an opening/closing valve 80 located at a position corresponding to the previously input sheet width (S112) so as to perform a printing operation. In contrast, in a case where the difference between the detected sheet width and the previously input sheet width exceeds the predetermined value, it is determined that a sheet having a width other than the previously input sheet width is fed. And then, an opening/closing valve 80 located at a position corresponding to the sheet width detected during a detecting operation is opened (S112) so as to perform the printing operation. Further, the sheet completely printed is discharged on the discharge tray 12 (S106).

In the present second embodiment, also in a case where the previously input sheet width is different from the width of the sheet actually fed, the opening/closing valves corresponding to the sheet width are opened, so as to achieve the printing operation on the sheet in a proper suction state.

Incidentally, the printing operation may be performed without any input of a sheet width and only based on the automatic detection result of the sheet width. Moreover, in a case where it is determined that the input sheet width is different from the width of the sheet actually fed, the printing operation may be stopped, and then, a user may be notified of the feeding of an unplanned sheet.

In the above-described embodiments, the four-side marginless printing can be performed with respect to a cut sheet. Moreover, it is possible to securely perform the marginless printing with respect to sheets having various sizes.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-108000, filed May 27, 2015, which is hereby incorporated by reference herein in its entirety.

What is claimed is:

1. A printing apparatus comprising:

a printhead configured to print on a sheet by ejecting ink;

a conveyance unit configured to convey the sheet in a first direction;

a platen including:

a plurality of supporting portions configured to support the sheet at a position opposing the printhead, wherein each of the supporting portions includes a supporting surface which is formed on a ribbed projection having a rectangular shape and contacts the sheet, a recess surrounded by the supporting surface, and a suction hole provided at the recess for suctioning the sheet onto the supporting surface, the plurality of supporting portions being positioned along a second direction crossing the first direction, a plurality of first negative pressure chambers provided corresponding to the plurality of supporting portions, the pressure chambers communicating with the suction hole, and a second negative pressure chamber communicating with the plurality of first negative pressure chambers; and a fan configured to communicate with the second negative pressure chamber and generate negative pressure in the second negative pressure chamber and the plurality of first negative pressure chambers.

2. The printing apparatus according to claim 1, wherein the conveyance unit includes a conveyance roller disposed upstream of the supporting portions with respect to the first direction and a discharge roller disposed downstream of the supporting portions with respect to the first direction.

3. The printing apparatus according to claim 2, wherein the platen includes a first ink receiving portion disposed at a portion between the supporting portions and the discharge roller with respect to the first direction to receive ink ejected from the printhead and a second ink receiving portion disposed at a position between the supporting portions and the conveyance roller with respect to the first direction to receive ink ejected from the printhead.

4. The printing apparatus according to claim 3, wherein each of the first ink receiving portion and the second ink receiving portion comprises an ink groove extending in the second direction.

5. The printing apparatus according to claim 4, further comprising an ink absorber disposed in the ink grooves.

6. The printing apparatus according to claim 1, further comprising valves provided in a plurality of openings through which the first negative pressure chambers communicate with the second negative pressure chamber.

7. The printing apparatus according to claim 6, wherein in a case where a print operation is performed by the printhead, one of the valves corresponding to an area through which the sheet passes is opened and another of the valves corresponding to an area through which the sheet does not pass is closed.

* * * * *